US005769163A

United States Patent [19]

Meynier

[11] Patent Number: 5,769,163

[45] Date of Patent: Jun. 23, 1998

[54] ADJUSTABLE FLEXIBILITY ANCHOR DEVICE WITH RETRACTABLE ARMS FOR WELL TOOLS

[75] Inventor: Patrick Meynier, Chatou, France

[73] Assignee: Institut Francais du Petrole, Rueil-Malmaison, France

[21] Appl. No.: 645,414

[22] Filed: May 13, 1996

[30] Foreign Application Priority Data

May 16, 1995 [FR] France ..... 95 05895

[51] Int. Cl.[6] ..... E21B 23/00

[52] U.S. Cl. ..... 166/206; 166/212

[58] Field of Search ..... 166/206, 212, 166/250

[56] References Cited

U.S. PATENT DOCUMENTS

| | | | |
|---|---|---|---|
| 3,177,938 | 4/1965 | Roussin . | |
| 3,565,170 | 2/1971 | Urbanosky . | |
| 3,798,966 | 3/1974 | Planche . | |
| 4,116,274 | 9/1978 | Rankin et al. | 166/250 |
| 4,184,546 | 1/1980 | Nicolas et al. | 166/206 |
| 4,365,668 | 12/1982 | Bright | 166/212 X |
| 4,428,422 | 1/1984 | Laurent | 166/212 |
| 4,610,309 | 9/1986 | O'Brien et al. | 166/206 X |
| 4,616,703 | 10/1986 | Laurent et al. . | |
| 4,715,469 | 12/1987 | Yasuda et al. | 166/212 X |
| 4,819,760 | 4/1989 | Petermann . | |
| 4,926,937 | 5/1990 | Hademenos | 166/206 |
| 5,127,477 | 7/1992 | Schultz . | |
| 5,259,452 | 11/1993 | Wittrisch | 166/250 |

FOREIGN PATENT DOCUMENTS 0584997 3/1994 European Pat. Off. .

*Primary Examiner*—Frank Tsay

*Attorney, Agent, or Firm*—Antonelli, Terry, Stout & Kraus, LLP

[57] ABSTRACT

An elastic force generated by a volume of compressed gas in a chamber (7*b*) of a cavity (7) interior to the body of a well tool (1), acting on a piston (8), is used to open arms (4) intended to anchor the tool to the wall of a well (2). In order to close them, an opposed hydraulic force generated by a pump (13) driven by an electric motor (14) is applied intermittently, which brings piston (8) back to a recoil position. Piston (8) is coupled hydraulically with the cylinders of jacks (5, 6) acting on arms (4). A sufficient elastic force can thus be generated under a very low volume and the characteristics thereof can be readily changed by acting on the gas injection pressure and/or the extent of the dead volume when piston (8) is in a recoil position. Such device can be used for coupling sondes in wellbores for seismic prospecting for example.

15 Claims, 2 Drawing Sheets

ADJUSTABLE FLEXIBILITY ANCHOR DEVICE WITH RETRACTABLE ARMS FOR WELL TOOLS

BACKGROUND OF THE INVENTION

FIELD OF THE INVENTION

The present invention relates to an anchor device with retractable arms and of adjustable flexibility, suited to maintain intermittently, inside a wellbore into which it is lowered at the end of a cable, a tool (or a sonde) provided with a measuring equipment that can be used notably in seismic prospecting, as well as a servicing assembly using this device.

A tool or sonde can be equipped for example with seismic pickups such as geophones in order to collect P or S type seismic waves transmitted by a seismic energy source placed for example at the surface and reflected by the subsoil discontinuities.

The sonde is equipped for example with a measuring equipment intended for the study of the geologic formations encountered or to carry out seismic prospecting operations in formations crossed through by the wellbore.

The tools or sondes are lowered into wells at the end of a cable that most often carries an electrical cable. They are generally provided with one or more swivel arms that can be opened or closed at will by motive means. In geophysical applications for example, the seismic pickups are placed so as to be pressed with a sufficient force against the wall of the well by the opening of the anchor arms. In order to obtain a sufficient coupling, the anchoring force is usually equal to several times the weight of the tool.

The motive means allowing the arms to be swivelled can be a hydraulic type. An electric motor controlled from a surface installation drives a hydraulic pump that supplies fluid under pressure to either a single jack acting on the swivel arms by means of links, or to jacks acting directly on the swivel arms. The force applied to the arms is independent of the distance thereof from the body of the sonde.

These motive can also be electromechanical means and include for example an endless screw driven in rotation by an electric motor also controlled from the surface. A nut to which one or more links connected to the swivel arms are secured is caused to move by the rotation of the screw. For safety reasons, in order that the arms can always be retracted even when the driving motor is stopped, the ends of the links can be secured to a ring on which a spring rests. The recoil thereof has the effect of pushing the ring and of triggering the spreading of the arms. The motor is used only for closing the arms. The displacement of the nut controlled by the rotation of the endless screw causes the nut to move away and the spring to be compressed. In case the motor is stopped, the recoil of the ring, combined with the compression of the spring, allows the arms to move closer.

The drawback of these elastic link layouts is that the springs necessary to obtain a high supporting force, for example in the field of geophysics, are most often heavy and bulky, which complicates the construction of tools of relatively small section suited to that of the wells that are generally drilled.

SUMMARY OF THE INVENTION

The anchor device according to the invention allows the intermittent anchoring of a tool or sonde lowered in a well, connected to a surface installation by an electro-carrying cable, by shifting an anchor element such as an articulated mobile arm with respect to the body of the tool, between a retracted position close to the body and a spread position, while avoiding the drawbacks linked with the use of springs for creating elastic opening forces.

It includes, in the body of the tool, a hydraulic pump actuated by driving means, a piston tightly dividing an elongated cavity of the body into two chambers, the piston being shiftable in the cavity under the action of two opposed forces.

The invention includes a pressurized gas reserve for creating a first one of these two forces in a second chamber, the second force being created in the first chamber by a hydraulic fluid delivered by the hydraulic pump, by means of a solenoid valve, the expansion of the gas tending to shift the piston in such a direction that it causes the opening of each anchor element, the second force being used to close the mobile element again.

The means for shifting each anchor element comprise for example a hydraulic jack consisting of a cylinder in which a link slides, the piston includes a rod that slides tightly in a chamber filled with a hydraulic liquid, this chamber communicating with the cylinder of each hydraulic jack.

The pump is placed for example in a chamber of the body communicating with a compensation chamber for adjusting permanently the pressure of the hydraulic fluid in the chamber to the pressure prevailing outside the tool.

In order to modify the stiffness of the spring consisting of the volume of gas in the second chamber, it is possible to use an adjustable stop for example or to set elements in the second chamber containing the pressurized gas so as to vary the dead volume thereof.

The device advantageously comprises means for regulating the pressure of the gas in the second chamber.

The invention further relates to a well servicing assembly which includes at least one well tool using the anchor device defined above, this tool comprising housings for pickups and at least one compartment for electronic intended to adjust the signals delivered by the pickups.

The force that allows each mobile element to be anchored in the walls is created by a pressurized gas reserve whose volume and mass are much lower than those occupied by the springs in prior devices. Besides, the anchoring force can be readily modified by changing the gas confining pressure in the second chamber prior to lowering the tool into the well or optionally in situ by means of a pressurized gas reserve housed in the body. The stiffness of this gaseous mass can also be modified by changing the ratio of the maximum and minimum volumes of this second chamber.

BRIEF DESCRIPTION OF THE DRAWINGS

Other features and advantages of the device according to the invention will be clear from reading the description hereafter of an embodiment given by way of non limitative examples, with reference to the accompanying drawings in which.

DESCRIPTION OF THE PREFERRED EMBODIMENTS

Figure 1A:
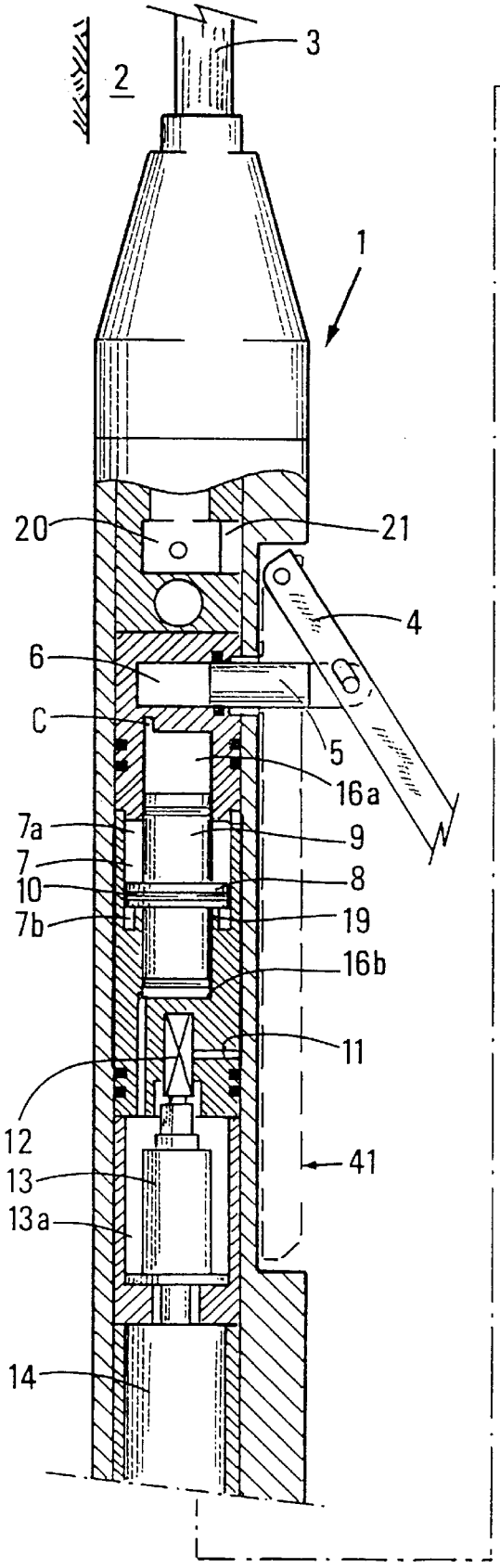
FIG. 1 diagrammatically shows a cutaway view of the body of the tool provided with the operating device.
Figure 1B:
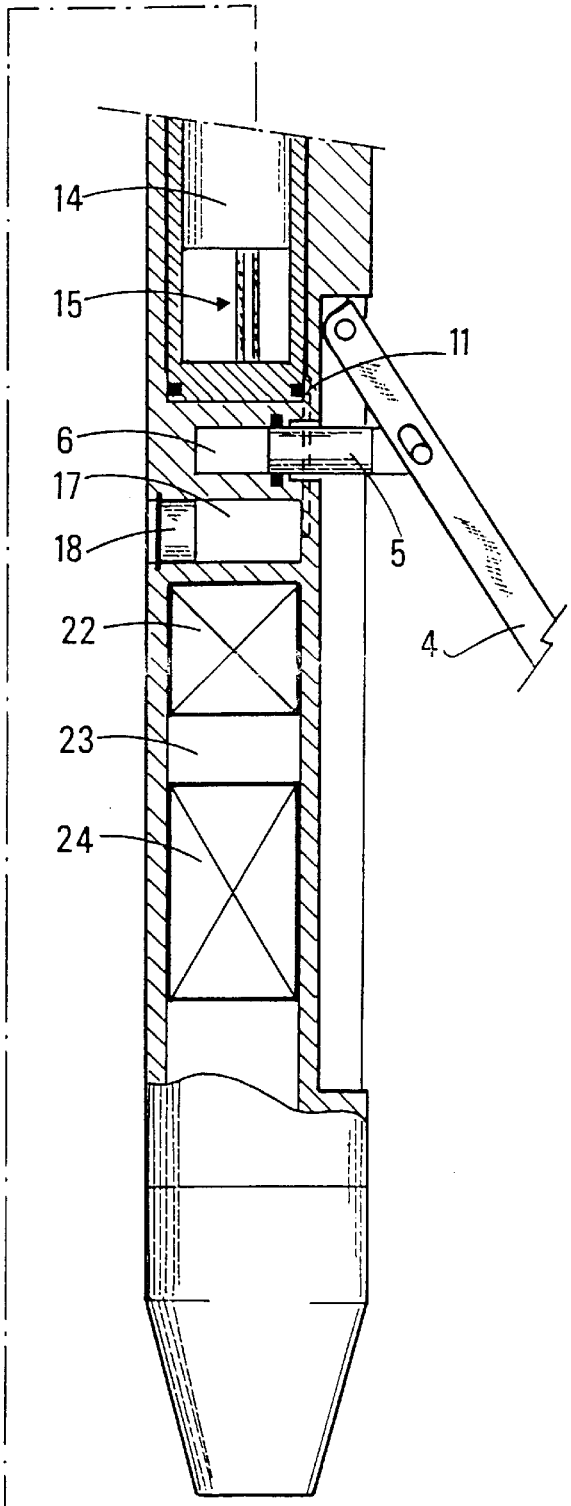

The body 1 of the tool or sonde suspended from a multistrand electrical cable 3 of a well-known type is lowered into a well 2. It can be firmly pressed against the wall through the swivelling of at least at least one and preferably two anchor arms 4 from a retracted position 41 in contact with the body to a spread position and remove from being anchored by an opposite motion. The motions of each anchor arm 4 are controlled by the translation of a link 5 in a cylinder 6 perpendicular to the longitudinal axis of tool 1.

A piston 8 provided with seals 10, that tightly divides a cylindrical cavity 7 arranged along the longitudinal axis of the body 1 into two chambers 7*a*, 7*b*, slides in this cavity. The first chamber 7*a* is filled with liquid and communicates through channels 11 provided with a control solenoid valve (not shown) with a second cavity 12 containing a hydraulic pump 13. This pump 13 is actuated by an electric motor 14 connected by conductors 15 to the conductors of the electrical cable 3. The second chamber 7*b*, on the other side of piston 8, contains a pressurized gas.

Rod 9, on either side of piston 8, tightly moves in two coaxial chambers 16*a*, 16*b* that form the extension of the first cavity 7 respectively at the two opposite ends thereof and whose section is smaller than that of the two chambers 7*a*, 7*b*.

On the side of the first chamber 7*a*, chamber 16*a* is filled with hydraulic liquid and communicates with each cylinder 6 through a channel C. The section of this channel C is selected small enough to form a low-pass filter that prevents the vibrations that can be transmitted thereto by anchor arms 4 from being transmitted to piston 8 and the gaseous mass in chamber 7*b*.

Chamber 16*b* permanently communicates with the cavity 13 of the pump. The pressure of the hydraulic fluid of pump 13 is permanently maintained at a pressure equal to the hydrostatic pressure prevailing in the well, by a balancing cylinder 17 opening onto the outside of body 1, where a free piston 18 slides.

In a recoil position where the gas is the most compressed, piston 8 rests on a stop 19.

Vibration pickups 20 such as a triaxial geophone or triphone are preferably set in housings 21 near to at least one of the points where the anchoring force pressing the body 1 of the tool against the wall of well 2 is exerted. Pickups 20 are connected by conductors (not shown) to an amplification and filtering module 22 placed in a compartment 23 of the body. When several tools or sondes are lowered into a well in the form of a string, a communication module 24 intended for coding and decoding of the data (commands from the surface station and responses sent by the well equipment) transmitted on the lines of electro-carrying cable 3 is set in the compartment 23 of the top sonde (that is the closest to the surface).

Method of operation: The tool (or optionally the string of tools) is lowered into the well. Once it has reached a depth where measuring operations are to be carried out, the opening of the solenoid valve is controlled on each channel 11, which frees each piston 8 from the hydraulic pressure that keeps it in a recoil position against stop 19. The pressurized gas in chamber 7*b* then pushes back piston 8 that compresses the fluid in chamber 7*a*. The pressure of the gas is consequently transmitted to the fluid in cylinders 6 and links 5 shift, which causes arms 4 to open until they are anchored against the wall of well 2.

Figure 3:
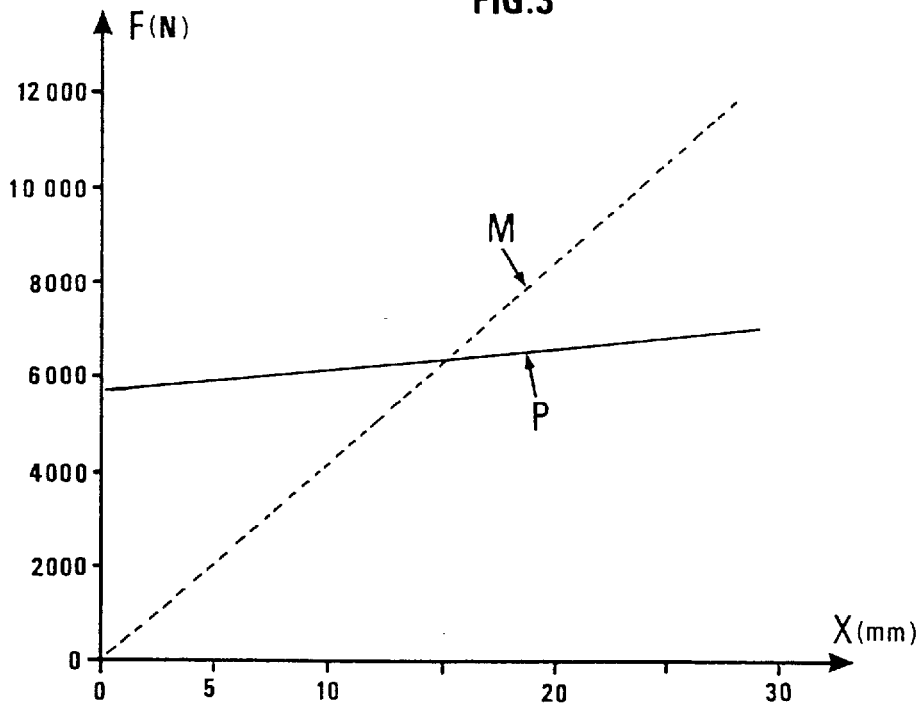
FIG. 3 shows another example of a variation curve P of the force generated by the volume of gas as a function of the displacement X of the piston, for another value VM2=110 $cm^3$ of the dead volume, and by comparison the linear variation curve M of the force generated by a mechanical spring.

FIG. 3 shows the variation curves of the anchoring force as a function of the displacement of the piston, one, P is the force generated by a mass of gas (110-$cm^3$ dead volume), and M is the force generated by a much bigger mechanical spring that is 8 cm in diameter, 20 cm long and consists of a 1-cm diameter wire as in the prior art. It can also be noted that the pneumatic spring used is more efficient than such a mechanical spring within a relatively long elongation range. The use of this pneumatic spring thus simplifies the construction of the body of the tool.

When operations in progress at this stopping depth are complete and the tool or string of tools has to be shifted to a different depth, the power supply of electric motor 14 is controlled so as to pressurize the hydraulic fluid delivered by pump 13 and to cause piston 8 to move back towards stop 19. Each solenoid valve controlling channels 11 is then closed.

Because of the elasticity of the pressurized gas in chamber 7*b*, the arms in open position have a certain latitude of motion so that the tool can nevertheless be taken up to the surface in case the electric motor-hydraulic pump assembly 13, 14 does not answer or deliver the required pressure for any reason.

Figure 2:
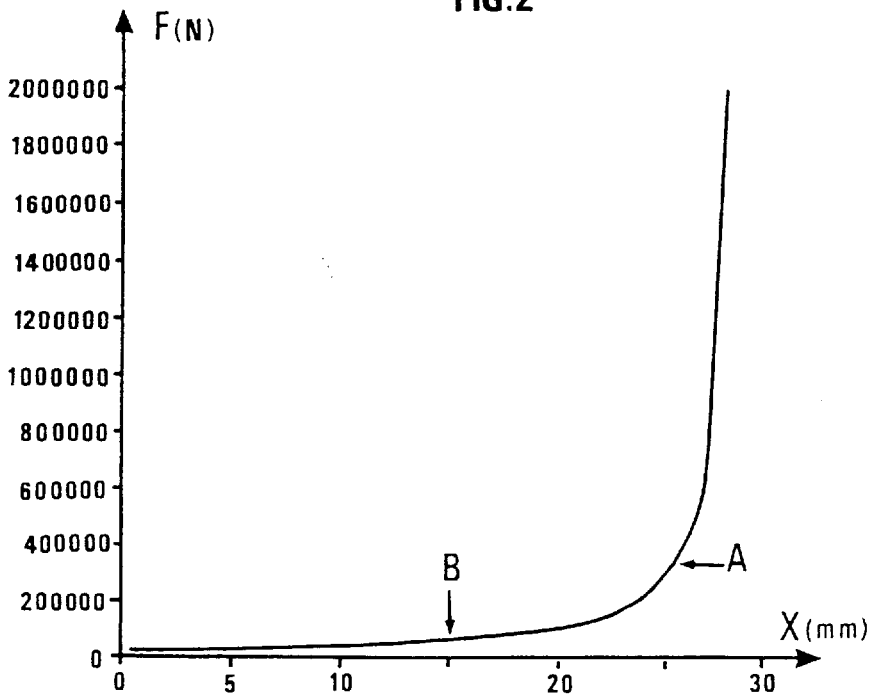
FIG. 2 shows an example of a variation curve of the force F1 generated by the volume of gas as a function of the displacement X of the piston, for a first value VM1=0 of the dead volume VM (volume of gas behind the piston in recoil position)

By changing the ratio between the maximum volume of chamber 7*b* and the dead volume (minimum volume of chamber 7*b* when piston 8 is pressed against stop 19), the stiffness of the spring consisting of the gas can be varied in considerable proportions. One can select an operating zone where the stiffness K, which is the value of the slope of the curve (FIG.2), varies substantially with the elongation (zone A), or another (zone B) where it is substantially constant.

The stiffness K can be varied by means of an adjustable stop 19, or by setting one or more disks in the annular chamber 7*b* so as to decrease the dead volume.

The anchoring force depends on the gas pressure in chamber 7*b*. It can be readily modified by changing the gas injection pressure, either at the surface prior to lowering the tools, or during operations from a gas accumulator (not shown) placed under high pressure, that is situated in the body of the tools. The device also preferably comprises a control that is not shown, allowing the pressure in chamber 7*b* to be adjusted so as to take account of the variations in the temperature prevailing in the well, either through gas release out of body 1, or by injection from the gas accumulator, so as to obtain a preferably substantially uniform anchoring force.

It can be readily checked that the volume of gas necessary to obtain an anchoring force equal to several times the weight of the tool or sonde is relatively low (of the order of 100 to 200 $cm^3$) in relation to the volume that would be occupied by a spring capable of providing an equivalent anchoring force.

Without departing from the scope of the invention, each mobile arm 4 can be replaced by any equivalent anchor element: piston, shoe, etc, shiftable by action on links 5.

Without departing from the scope of the invention, a single mixed hydraulic-pneumatic operating device as described above can be used, set in a main sonde body in order to control the opening of the arms of several satellite several satellite sondes linked to the main sonde by linking means described for example in French patents 2,636,741 and 2,685,139.

I claim:

1. A well tool comprising: a tool body provided with an elongated cavity lowered into a well, connected to a surface installation by an electrical cable, an anchoring device for intermittently anchoring the tool in the well, by shifting at least one anchor element with respect to the body of the tool, between a retracted position close to the body and a spread position where the anchor element is anchored to the wall of the well, a shifting device in the body for shifting the at least one anchor element including a hydraulic pump for generating pressurized hydraulic fluid, an activator for actuating the hydraulic pump, a piston dividing the elongated cavity into a first chamber and a second chamber, the piston being shiftable in the elongated cavity under action of two opposed forces, a pressurized gas reservoir creating a first of the two opposed forces in the second chamber, a second of the two opposed forces being generated in the first chamber by the pressurized hydraulic fluid and wherein expansion of the pressurized gas moves the piston in a direction causing opening of the at least one anchor element and the second force causing the retracting of the anchor element back to the retracted position.

2. A well tool as claimed in claim 1, wherein:

the elongated cavity includes a third chamber filled with a hydraulic liquid, the shifting device comprises a hydraulic jack having a cylinder, a link sliding in the cylinder, the piston comprising a rod sliding in the third chamber and the third chamber communicating with the cylinder of the hydraulic jack.

3. A well tool as claimed in claim 1, comprising: an additional chamber in the tool body and a pressure adjustment device, the hydraulic pump being disposed in the additional chamber which communicates with the pressure adjustment device for adjusting pressure of the hydraulic fluid of the additional chamber to a pressure prevailing outside the tool.

4. A well tool as claimed in claim 2, comprising: an additional chamber in the tool body and a pressure adjustment device, the hydraulic pump being disposed in the additional chamber which communicates with the pressure adjustment device for adjusting pressure of the hydraulic fluid of the additional chamber to a pressure prevailing outside the tool.

5. A well tool as claimed in claim 1, further comprising: a mechanism for changing the second force.

6. A well tool as claimed in claim 5, wherein: the mechanism comprises a charged volume of gas in the second chamber.

7. A well tool as claimed in claim 2, further comprising: a mechanism for changing the second force.

8. A well tool assembly as claimed in claim 5, wherein the mechanism comprises an adjustable stop.

9. A well tool assembly as claimed in claim 6, wherein the mechanism comprises an adjustable stop.

10. A well tool assembly as claimed in claim 5, wherein the mechanism for changing comprises elements placed in the second chamber for varying the volume thereof.

11. A well tool assembly as claimed in claim 7, wherein the mechanism for changing comprises elements placed in the second chamber for varying the volume thereof.

12. A well tool assembly as claimed in claim 1, further comprising: means for regulating gas pressure in the second chamber.

13. A well tool assembly as claimed in claim 2, further comprising: means for regulating gas pressure in the second chamber.

14. A well tool as claimed in claim 1, further comprising: housings for sensors and at least one compartment for electronics for adjusting signals delivered by the sensors.

15. A well tool as claimed in claim 2, further comprising: housings for sensors and at least one compartment for electronics for adjusting signals delivered by said sensors.

* * * * *